US011458360B2

(12) United States Patent
Manson

(10) Patent No.: US 11,458,360 B2
(45) Date of Patent: Oct. 4, 2022

(54) EXERCISE STEP BOX

(71) Applicant: Timothy Ray Manson, Redmond, WA (US)

(72) Inventor: Timothy Ray Manson, Redmond, WA (US)

( * ) Notice: Subject to any disclaimer, the term of this patent is extended or adjusted under 35 U.S.C. 154(b) by 143 days.

(21) Appl. No.: 16/702,175

(22) Filed: Dec. 3, 2019

(65) Prior Publication Data

US 2021/0162258 A1 Jun. 3, 2021

(51) Int. Cl.
*A63B 23/04* (2006.01)
*A63B 21/00* (2006.01)

(52) U.S. Cl.
CPC ..... *A63B 23/0464* (2013.01); *A63B 23/0458* (2013.01); *A63B 21/4037* (2015.10); *A63B 2209/00* (2013.01)

(58) Field of Classification Search
CPC ..... A63B 21/00047; A63B 21/4037; A63B 23/0464; A63B 23/0458; A63B 2209/00; A47C 12/00; A47C 12/02
See application file for complete search history.

(56) References Cited

U.S. PATENT DOCUMENTS 232,140 A 9/1880 Mason
5,037,084 A * 8/1991 Flor ..... A63B 23/0458 482/52
5,176,596 A * 1/1993 Ullman ..... A63B 23/0458 108/19
D416,633 S 11/1999 Horton
6,290,628 B1 * 9/2001 Wilkinson ..... A47C 3/20 482/52
D497,011 S 10/2004 Poliacek et al.
D513,808 S 1/2006 Zwaan
D516,360 S 3/2006 Henning
7,335,146 B2 * 2/2008 Gerstung ..... A63B 69/0035 482/142
7,922,624 B1 4/2011 Fairhurst et al.
D709,968 S 7/2014 Weiss et al.
9,011,295 B2 * 4/2015 Orenstein ..... A63B 23/0458 482/52
D732,613 S 6/2015 Davies, III
D737,385 S 8/2015 Woniger et al.
D738,444 S 9/2015 Hilson
(Continued)

FOREIGN PATENT DOCUMENTS

FR 2547743 A1 * 12/1984 ..... A63B 23/0458
GB 2538716 A * 11/2016 ..... A63B 23/0405

*Primary Examiner* — Garrett K Atkinson
*Assistant Examiner* — Kathleen M Fisk
(74) *Attorney, Agent, or Firm* — Innovation Capital Law Group, LLP; Vic Lin

(57) ABSTRACT

An exercise step, usable for any of a variety of step exercises, can include a solid top surface that may be polygonal in shape. At least a portion of an underside of the exercise step can be formed in a honeycomb configuration, thereby reducing weight of the step as well as the material required to make the step. Handles may be formed by indentations in sides of the step for ease of lifting and positioning. The handles may be formed in opposites of the polygonal shape. In some embodiments, the polygonal shape may be symmetrical or may include longer and shorter sides in an alternating arrangement. At least a portion of the bottom of the step can be formed from an anti-slip material.

5 Claims, 5 Drawing Sheets

(56) References Cited

U.S. PATENT DOCUMENTS

| | | | | |
|---|---|---|---|---|
| D771,205 | S | 11/2016 | Davies, III | |
| D777,266 | S | 1/2017 | Davies, III | |
| D800,233 | S | 10/2017 | Januszek | |
| D802,063 | S | 11/2017 | Nelson | |
| D813,321 | S | 3/2018 | Zaki | |
| 10,076,680 | B2 * | 9/2018 | Hillson | A63B 21/00047 |
| D831,134 | S | 10/2018 | Hillson | |
| D840,481 | S | 2/2019 | Pryce | |
| D843,515 | S | 3/2019 | Agostini | |
| D898,841 | S | 10/2020 | Chiu | |
| D903,149 | S | 11/2020 | Chao | |
| D903,152 | S | 11/2020 | Chao | |
| 2005/0020418 | A1 * | 1/2005 | Lin | A63B 23/0458 482/142 |
| 2008/0157582 | A1 | 7/2008 | Bertele | |
| 2009/0291807 | A1 | 11/2009 | Moring et al. | |
| 2015/0005140 | A1 | 1/2015 | Adkins et al. | |
| 2019/0174684 | A1 | 6/2019 | Spence | |

* cited by examiner

EXERCISE STEP BOX

BACKGROUND OF THE INVENTION

1. Field of the Invention

Embodiments of the invention relate generally to exercise equipment. More particularly, embodiments of the invention relate to an exercise step box typically with a polygonal shape and a honeycomb interior design.

2. Description of Prior Art and Related Information

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Step exercises are a popular form of exercise where a user performs various tasks in stepping on and off a raised platform. Such exercise routines may be performed at a person's home or in a more formal workout setting, such as in a gym, community center, or the like. Each participant in such exercise typically provides their own step, or an organization may have a plurality of steps for use by participants, who then position their steps in a particular location for the exercise.

Because the user weight may vary, the steps need to be made strong enough to support the weight of the heaviest user thereof. In making the steps strong, the steps can become heavy, making movement, transport and storage more challenging.

In view of the foregoing, there is a need for an exercise step that can be kept relatively lightweight, while maintaining strength and being easy to move and position.

SUMMARY OF THE INVENTION

Embodiments of the present invention provide a step comprising a top surface defining an outer perimeter of the step the outer perimeter forming a polygonal shape; a bottom surface opposite the top surface, the bottom surface defining a bottom plane of the step, the bottom surface formed about an outer border of the bottom plane of the step, below the top surface; an open region inside the bottom surface, below the top surface; and a honeycomb pattern formed inside the open region.

Embodiments of the present invention further provide an exercise step comprising a top surface defining an outer perimeter of the step the outer perimeter forming a polygonal shape; a bottom surface opposite the top surface, the bottom surface defining a bottom plane of the step, the bottom surface formed about an outer border of the bottom plane of the step, below the top surface; a plurality of sides formed between the top surface and the bottom surface; at least one grip region formed from an indentation in at least one of the plurality of sides of the step; an anti-slip material covering at least a portion of the bottom surface; an open region inside the bottom surface, below the top surface; and a honeycomb pattern formed inside the open region.

Embodiments of the present invention also provide an exercise step comprising a top surface defining an outer perimeter of the step the outer perimeter forming a polygonal shape; a bottom surface opposite the top surface, the bottom surface defining a bottom plane of the step, the bottom surface formed about an outer border of the bottom plane of the step, below the top surface; an open region inside the bottom surface, below the top surface; and a honeycomb pattern formed inside the open region, wherein honeycomb pattern is formed from a plurality of honeycomb side walls disposed in the open region and extending downward from a bottom side of the top surface; and a length of which the honeycomb side walls extend downward from the bottom side of the top surface is greater adjacent the bottom surface and less at a center of the open region.

In some embodiments, the step further includes an anti-slip material covering at least a portion of the bottom surface.

In some embodiments, the step further includes at least one grip region formed from an indentation in at least one side of the step.

In some embodiments, the step is formed in a polygonal shape that has an even number of sides.

In some embodiments, the polygonal shape includes one or more pairs of long sides, disposed opposite each other, and one or more pairs of short sides, disposed opposite each other, where the long sides have a longer outer perimeter length than that of the short sides.

In some embodiments, a grip region is formed from an indentation formed in each of the short sides.

In some embodiments, the polygonal shape is an octagon.

These and other features, aspects and advantages of the present invention will become better understood with reference to the following drawings, description and claims.

BRIEF DESCRIPTION OF THE DRAWINGS

Some embodiments of the present invention are illustrated as an example and are not limited by the figures of the accompanying drawings, in which like references may indicate similar elements.

Figure 1:
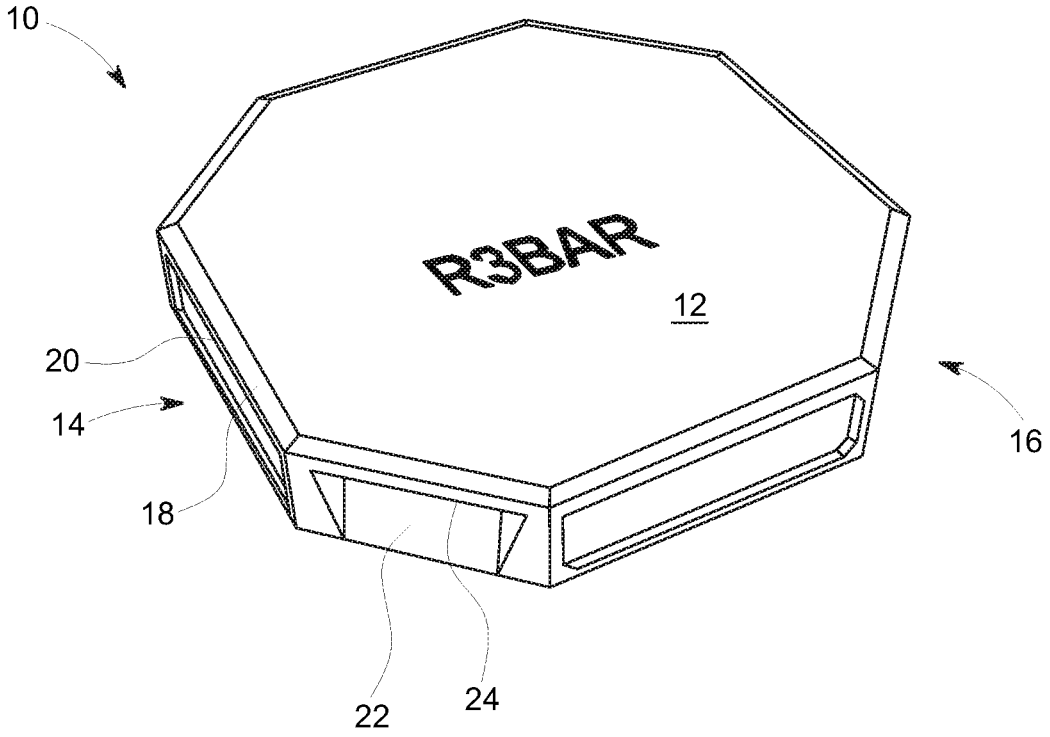
FIG. 1 illustrates a top perspective view of an exercise step according to an exemplary embodiment of the present invention.

Unless otherwise indicated illustrations in the figures are not necessarily drawn to scale.

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

In describing the invention, it will be understood that a number of techniques and steps are disclosed. Each of these has individual benefit and each can also be used in conjunction with one or more, or in some cases all, of the other disclosed techniques. Accordingly, for the sake of clarity, this description will refrain from repeating every possible combination of the individual steps in an unnecessary fashion. Nevertheless, the specification and claims should be read with the understanding that such combinations are entirely within the scope of the invention and the claims.

In the following description, for purposes of explanation, numerous specific details are set forth in order to provide a thorough understanding of the present invention. It will be evident, however, to one skilled in the art that the present invention may be practiced without these specific details.

The present disclosure is to be considered as an exemplification of the invention and is not intended to limit the invention to the specific embodiments illustrated by the figures or description below.

As is well known to those skilled in the art, many careful considerations and compromises typically must be made when designing for the optimal configuration of a commercial implementation of any device, and in particular, the embodiments of the present invention. A commercial implementation in accordance with the spirit and teachings of the present invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

Broadly, embodiments of the present invention provide an exercise step that can be used for any of a variety of step exercises. The exercise step includes solid top surface that may be polygonal in shape. At least a portion of an underside of the exercise step can be formed in a honeycomb configuration, thereby reducing weight of the step as well as the material required to make the step. Handles may be formed by indentations in sides of the step for ease of lifting and positioning. The handles may be formed in opposites of the polygonal shape. In some embodiments, the polygonal shape may be symmetrical or may include longer and shorter sides in an alternating arrangement. At least a portion of the bottom of the step can be formed from an anti-slip material.

Figure 2:
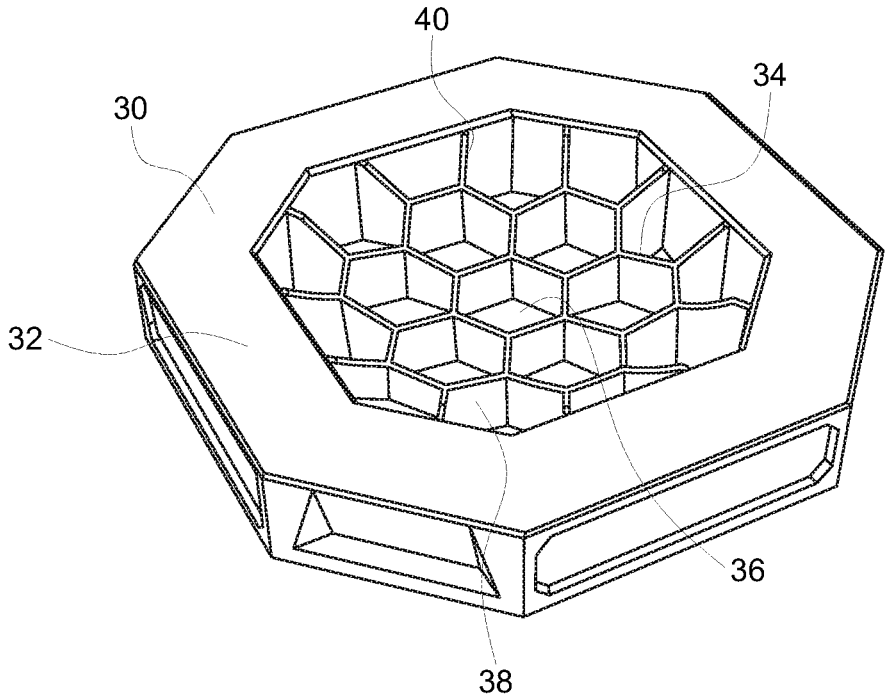
FIG. 2 illustrates a bottom perspective view of the exercise step of FIG. 1.

Referring now to FIGS. 1 and 2, an exercise step 10, also referred to as step 10, can include a top surface 12, defining a top plane of the step 10, and a bottom surface 30, defining a bottom plane of the step 10. Typically, the top surface 12 is substantially parallel to the bottom surface 30, however, in some embodiments, the top surface 12 may be disposed at an angle relative to the bottom surface. The bottom surface 30 can include an anti-slip coating 32, such as a foam, rubber, or the like, type of coating that can prevent inadvertent slippage of the bottom surface 30 along a surface, such as a floor.

Figure 3:
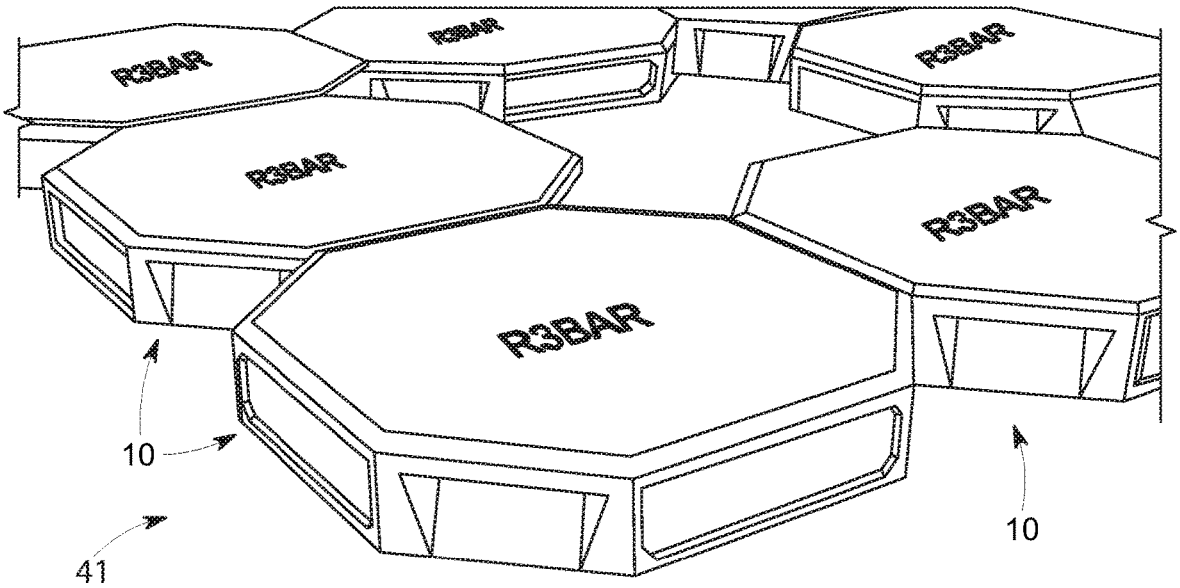
FIG. 3 illustrates one configuration where a plurality of the exercise steps of FIG. 1 may be positioned to create a larger exercise platform.

The step 10 may be formed in a polygonal shape. In some embodiments, as shown in the Figures, the shape may be an octagonal shape. In some embodiments, the octagonal shape can include short sides 16 and long sides 14, where the long sides 14 have an exterior perimeter length that is longer than that of the short sides 16. The short sides 16 and the long sides 14 may be disposed opposite each other. In some embodiments, two sets of opposing short sides 16 and two sets of opposing long sides 14 disposed in an alternating arrangement, may be used to form the polygonal shape. Such a pattern is shown in FIGS. 1 through 3. In some embodiments, the long sides 14 may be from about 1.5 to about 4 times the length of the short sides 16. Of course, other shapes and patterns for the step may be used within the scope of the present invention as defined by the claims. A bevel 18 may be disposed between the long and short sides 18, 16 and the top surface 12.

The long sides 14 may include a recessed central portion 20, as shown in the Figures. However, in some embodiments, the long sides 14 may be a solid, flush surface. The short sides 16 can include an indented region 22 that form a lifting surface 24 under the top surface 12, where a user's fingers may be inserted into the indented region 22 and the step 10 may be lifted by the lifting surface 24.

Referring specifically to FIG. 2, the bottom surface 30 may be disposed about an outer perimeter of the step 10. In some embodiments, a region between the bottom surface 30 and the top surface 12 may be hollow or may be filled with a supporting material. In some embodiments, this region between the bottom surface 30 and the top surface 12 may be enclosed, as shown in the Figures.

The bottom surface 30 can be disposed to form a border that forms an inner bottom region (defined by a bottom side 36 of the top surface 12 that is inside the border formed by the bottom surface 30) that may be filled in a honeycomb pattern 34. Through the use of such a pattern 34, rigidity of the step 10 can be realized without a need to use excess materials, resulting in a step 10 that is lighter and easier to transport to a location a user desires to perform step exercises. In some embodiments, the honeycomb pattern 34 can attach to the bottom surface 30 with sloped sides 40 that create honeycomb side walls 38 that become shorter toward a central region of the step 10. In other words, the honeycomb side walls 38 extend from the bottom side 36 of the top surface 12 such that the side walls 38 extend further down toward a bottom plane (as defined by the bottom surface 30) as the side walls 38 move from a central region toward the bottom surface 30. Typically, the honeycomb side walls 38 may extend perpendicular to a plane defined by the bottom surface 30, as shown in FIG. 2.

Referring to FIG. 3, there is shown a modular design 41 of a plurality of steps 10. The polygonal shape of the step 10 can permit a plurality of the steps 10 to be arranged in a certain pattern. As shown in FIG. 3, this pattern may result in a raised step region surrounding a non-step region. Such a pattern may be useful for certain exercises that may require steps while walking forward or backwards, or while side-stepping, for example.

Figure 4:
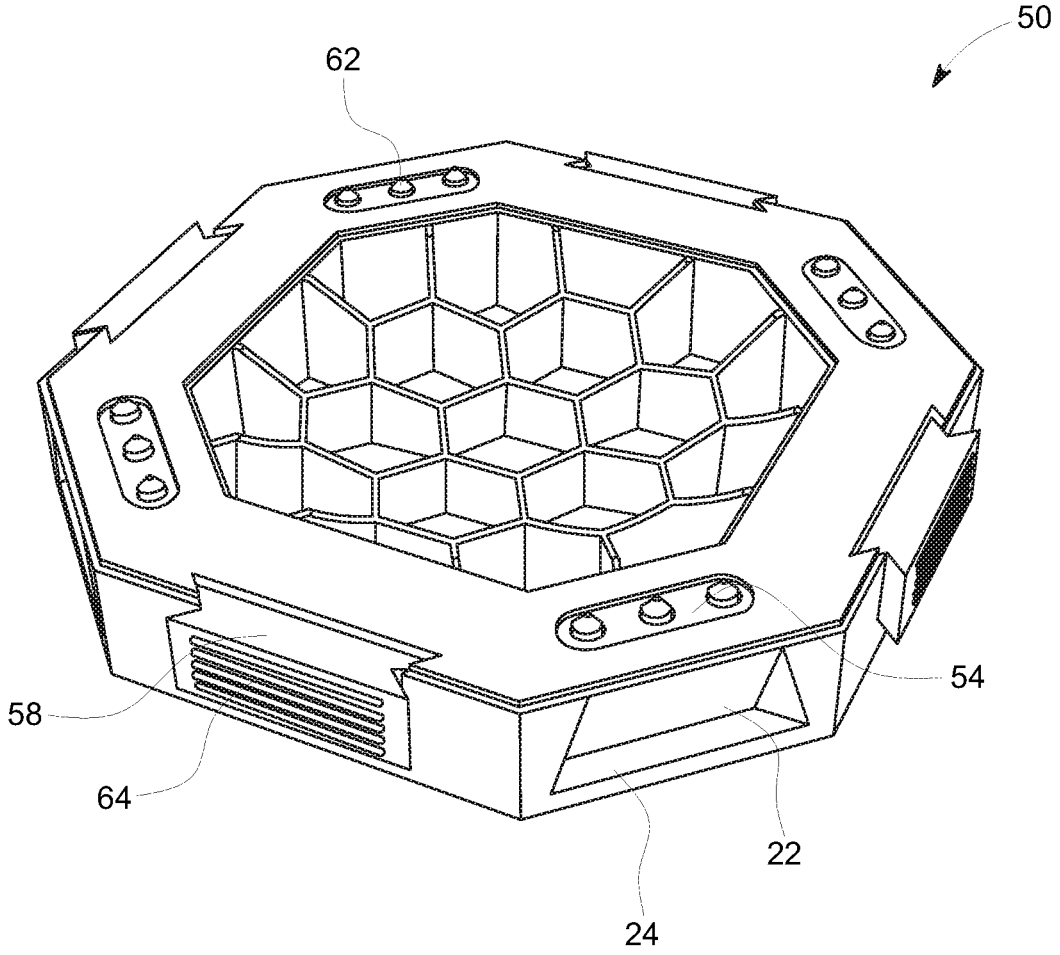
FIG. 4 illustrates a bottom view of an exercise step with grip feet and interconnection inserts, according to an exemplary embodiment of the present invention.
Figure 5:
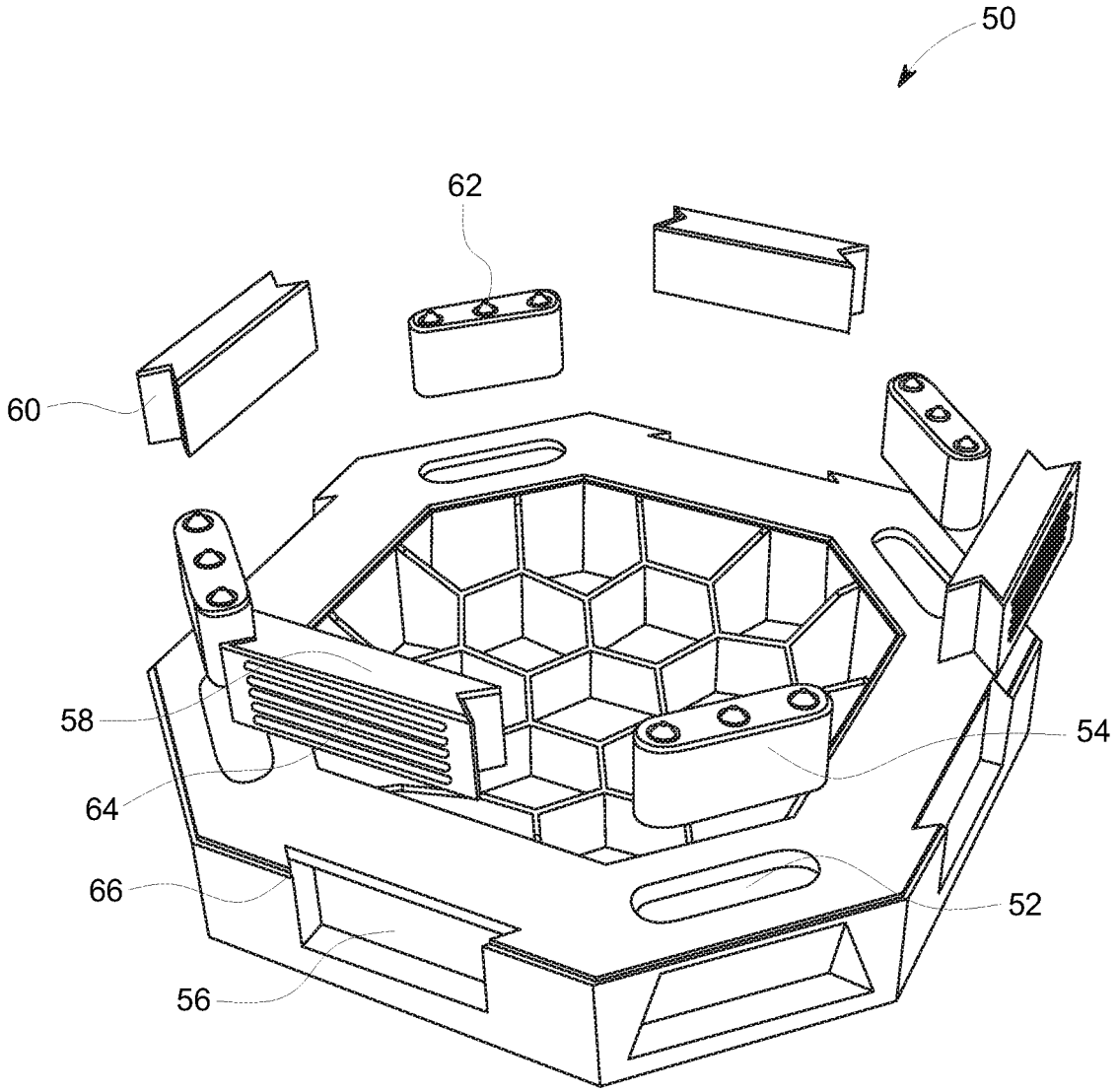
FIG. 5 illustrates an exploded bottom view of the exercise step of FIG. 4.

Referring now to FIGS. 4 and 5, an exercise step 50 can include modular cleat inserts 54 that may fit into openings 52 disposed on a bottom side thereof. The modular cleat inserts 54 can include cleats 62 that extend beyond a plane of the bottom side of the exercise step 50. The cleats 62 may be useful to add grip on a turf, turf-like or other similar surface. When not required, the modular cleat inserts 54 may be inserted upside-down, or the cleats 62 may retract, so that the exercise step 50 can rest on its bottom surface, similar to that described above with reference to FIGS. 1 through 3. The ability to move the cleats 62 between a protruding configuration (as shown in FIG. 4) and a non-protruding configuration can be useful in providing the ability to use the exercise step 50 on a variety of surfaces.

Indents 56 may be formed in one or more sides of the exercise step 50. As shown in FIGS. 4 and 5, four indents 56 may be formed uniformly about the exercise step 50. The indents 56 may communicate with a bottom side of the exercise step 50 as well as communicate with an outer periphery/outer edge of the exercise step 50. A connector 58 may fit into the indents 56 and a portion of the connector 58 may extend beyond an outer periphery of the exercise step 50 as shown in FIG. 4. The portion of the connector 58 that extends beyond the outer periphery of one exercise step 50 may be inserted into an indent 56 of another exercise step 50, thereby interconnecting the two exercise steps together via the connector 58.

As shown in FIG. 5, the indents 56 may form a frustro-conical cross-sectional shape (as viewed from the bottom side of the exercise step), where the indent 56 forms a widened portion 66 inside the exercise step 50. The connector 58 may have a mating shape, for example, with a side V-indent 60 formed therein. In this configuration, when the connector 58 is inserted in the indent 56, the widened portion 66 prevents inadvertently pulling the connector 58 out of the indent 56 due to a force parallel to the plane of the top and bottom surfaces of the exercise step 50. In some embodiments, a roughened surface 64 may be provided on opposing sides of the connector 58. Such a roughened surface 64 may help retain the connector 58 in the indent 56. Of course, other shapes may be utilized to form an interconnection mechanism for joining two or more of the exercise steps together.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a sub combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what incorporates the essential idea of the invention.

What is claimed is:

1. An exercise step comprising:

a top surface defining an outer perimeter of the exercise step, the outer perimeter forming a polygonal shape;

a bottom surface opposite the top surface, the bottom surface defining a bottom plane of the exercise step, the bottom surface formed about an outer border of the bottom plane of the exercise step, below the top surface;

a plurality of sides formed between the top surface and the bottom surface;

at least one grip region formed from an indentation in at least one of the plurality of sides of the exercise step;

an anti-slip material covering at least a portion of the bottom surface;

an open region inside the bottom surface, below the top surface;

a honeycomb pattern formed inside the open region; and modular cleat inserts removably positioned into openings in the bottom surface of the exercise step, the modular cleat inserts including cleats that are extendable beyond the bottom plane, the openings having an outer periphery surrounded by the bottom surface.

2. The exercise step of claim 1, wherein the polygonal shape includes one or more pairs of long sides, disposed opposite each other, and one or more pairs of short sides, disposed opposite each other, where the long sides of each of the one or more pairs of long sides have a longer outer perimeter length than that of the short sides of each of the one or more pairs of short sides.

3. The exercise step of claim 1, wherein the honeycomb pattern is formed from a plurality of honeycomb side walls disposed in the open region and extending downward from a bottom side of the top surface.

4. The exercise step of claim 1, wherein the modular cleat inserts are movable between a protruding configuration and a non-protruding configuration within the openings.

5. The exercise step of claim 1, further comprising connectors removably fitting into at least one of the plurality of sides of the exercise step, wherein a portion of the connectors extend outward from at least one of the plurality of sides of the exercise step, wherein the portion is configured to removably fit into one of the plurality of sides of a second one of the exercise step.

* * * * *